United States Patent [19]

Jones et al.

[11] 4,433,496

[45] Feb. 28, 1984

[54] LOCKING DEVICE FOR EXCAVATING EQUIPMENT

[75] Inventors: Larren F. Jones, Beaverton; Jeffrey P. Earll, Portland, both of Oreg.

[73] Assignee: ESCO Corporation, Portland, Oreg.

[21] Appl. No.: 475,186

[22] Filed: Mar. 14, 1983

[51] Int. Cl.[3] ..... E02F 9/28

[52] U.S. Cl. ..... 37/141 R; 24/704; 24/573; 299/91; 403/358; 403/370; 403/374; 403/378; 411/75

[58] Field of Search ..... 37/142 A, 142 R, 141 T, 37/141 R; 403/378, 379, 358, 370, 374; 299/91, 93, 92; 411/75, 76; 175/413; 24/201 LP, 263 SW

[56] References Cited

U.S. PATENT DOCUMENTS

| | | | |
|---|---|---|---|
| 1,992,591 | 2/1935 | Whisler | 37/142 R |
| 3,413,739 | 12/1968 | Guinot | 37/142 R |
| 4,267,653 | 5/1981 | Hahn et al. | 37/142 A |
| 4,271,615 | 6/1981 | Jones | 37/142 A |
| 4,373,831 | 2/1983 | Crawford | 403/358 X |

*Primary Examiner*—William Pieprz
*Assistant Examiner*—Moshe I. Cohen
*Attorney, Agent, or Firm*—Tilton, Fallon, Lungmus & Chestnut

[57] ABSTRACT

A locking device for securing a straddle-type adapter to the lip of an excavator wherein the C-clamp and wedge have cooperating arcuate surfaces and are bolted together whereby tightening the bolt moves the wedge on the arcuate surface of the C-clamp to tighten the fit of the adapter on the lip.

8 Claims, 5 Drawing Figures

FIG. 1
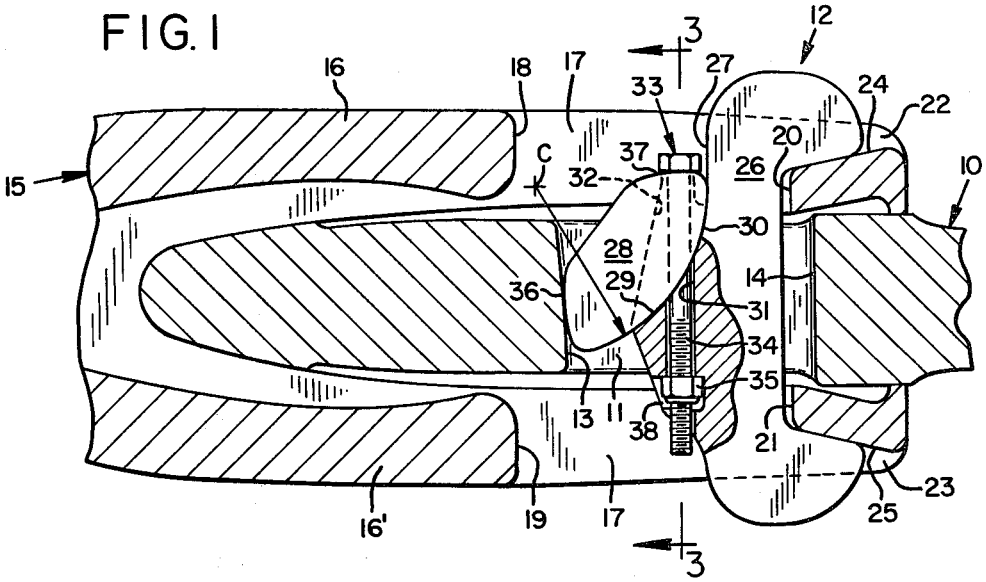
FIG. 2
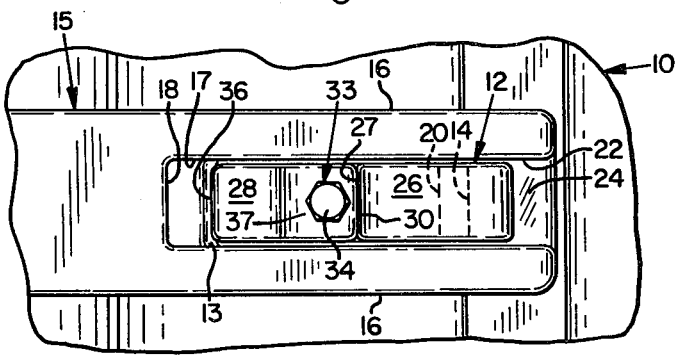
FIG. 3
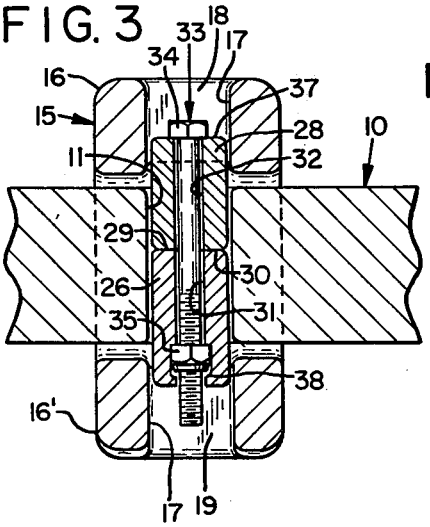
FIG. 4
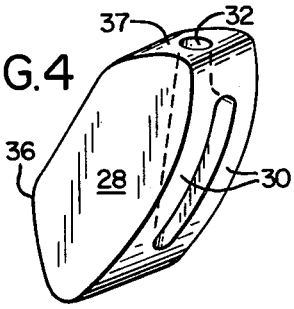
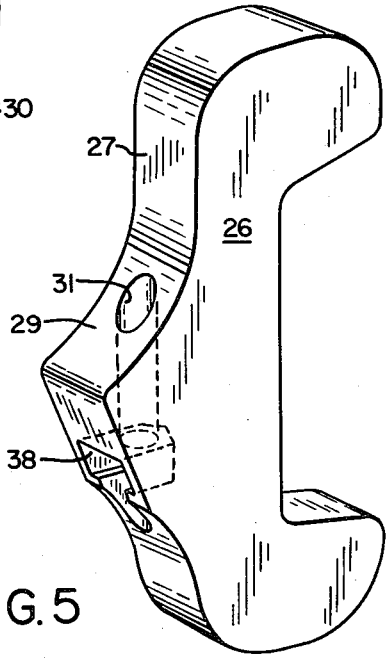
FIG. 5

LOCKING DEVICE FOR EXCAVATING EQUIPMENT

BACKGROUND OF THE INVENTION

This invention relates to a locking device for excavating equipment and, more particularly, to a device including a C-shaped clamp member and a wedge member useful in securing an adapter to the lip of a shovel dipper, bucket, etc.

The instant invention finds use in the same environment of earlier co-owned U.S. Pat. No. 4,271,615, i.e., for securing a Whisler adapter to the lip of a piece of excavating equipment. The Whisler type adapter has bifurcated arms so as to slip over the lip of the excavator—in the fashion seen in Whisler U.S. Pat. No. 1,992,591.

Historically, the art workers have used C-clamps and wedges for securing the adapter to a lip. The problem has always been to achieve a reliable securement, yet one which can be disassembled for removal of the adapter when repair is necessary. These conflicting goals have resulted in a wide variety of locking structures, see also co-owned U.S. Pat. No. 4,267,653.

We have found that an especially advantageous locking operation is achieved by departing from the classical C-clamp and wedge construction and utilizing, instead a pair of members equipped with confronting arcuate bearing surfaces which develop the wedging action necessary for securement in a novel and advantageous way.

More particularly the C-clamp member is equipped with a forwardly facing wall having a forwardly projecting arcuate surface and the wedge member has a rearwardly facing wall having an arcuate contour for sliding on the C-clamp member arcuate surface, the two members being connected by a tightenable bolt means causing the two members to slide relative to each other and achieve a snug fit within aligned openings in the adapter and lip—thereby releasably securing the adapter on the lip.

Other objects and advantages of the invention may be seen in the details of the ensuing specification.

The invention is described in conjunction with an illustrative embodiment in the accompanying drawing, in which:

FIG. 1 is a fragmentary side elevational view, partially in section, of excavating equipment featuring the inventive lock;

FIG. 2 is a fragmentary top plan view of the structure seen in FIG. 1;

FIG. 3 is a vertical sectional view taken along the sight line 3—3 of FIG. 1;

FIG. 4 is a perspective view of the wedge member portion of the lock; and

FIG. 5 is a perspective view of the C-clamp member portion of the lock.

DETAILED DESCRIPTION

In the illustration given and with reference first to FIG. 1, the numeral 10 designates generally a portion of the lip of an excavator (not shown). As mentioned previously the excavator can take the form of a shovel dipper, bucket, etc. The lip, in conventional fashion, is equipped with a vertically extending opening 11 for the purpose of receiving the lock generally designated 12.

The lip opening 11 is defined by a forward bearing wall 13 an a rear non-bearing wall 14.

The adapter, also shown in fragmentary form is generally designated 15 and is equipped with upper and lower legs 16 and 16' which straddle the lip 10. The adapter 15 is equipped also with a vertically extending opening 17—extending through both legs 16 and 16' and being aligned therein. The opening 17 is defined in part by forward walls 18 and 19 (in the legs 16 and 16', respectively) and rear walls 20 and 21 (also, respectively, in the legs 16 and 16'). The upper and lower portion of the legs 16 and 16' are recessed as at 22 and 23 to provide bearing walls as at 24 and 25 for the lock 12, more particularly, the C-clamp member 26. Here it will be appreciated that the rear portion of the C-clamp member 26 is of conventional construction and may take a variety of forms available to those skilled in the art, the invention being concerned with the forwardly facing wall of the C-clamp member 26. More particularly, the invention is concerned with the wall 27 of the C-clamp member 26 which is in confronting, bearing relation with the wedge member 28.

The forwardly facing wall 27 of the C-clamp member 26 (see particularly FIG. 5) is equipped with a forwardly projecting arcuate surface 29. This is integral with C-clamp member 26 and is positioned in the portion of the C-clamp member 26 located within the lip opening 11.

Correspondingly, the wedge member 28 is also equipped with an arcuate contour in the wall 30 confronting the arcuate surface 29, i.e., in the rearwardly facing wall of the wedge member 28.

The C-clamp 26 is equipped with a vertical passage 31 and the wedge member 28 is also equipped with a vertical passage 32—but which is flared, i.e., enlarged adjacent the wall 30. These passages are arranged to be aligned as seen in FIG. 1 and extending thereto is a bolt means generally designated 33. More particularly, the bolt means the 33 includes a headed, threaded bolt 34 and a nut 35.

Both arcuate surfaces 29 and 30 are generated about the same center of curvature. In the illustration given, this center C is located forwardly of the bolt means 33. Thus, tightening, i.e., shortening of the bolt means 33 causes clockwise pivotal movement of the wedge member 28.

In operation, the bolt means 33 is tightened causing the wedge member to slide down the projecting arcuate surface 29 and engage the forward bearing wall 13 of the lip opening 11 while reminaing in bearing relation with the C-clamp member 26.

For this purpose, there is provided on the forward portion of the wedge member 28 a generally arcuate surface 36. Also to insure proper contact of the head of the bolt 34 with the wedge member 28, there is provided an arcuate surface 37—see FIG. 4. In some instances, it may be advantageous to provide rubber bushings or shock absorbers in conjunction with the arcuate surfaces 36 and 37.

OPERATION

In the operation of the invention, the adapter 15 is mounted on the lip 10 by a rearward sliding movement whereby the upper and lower legs 16 and 16' straddle the forwardly projecting lip. This brings the openings, 11 in the lip and 17 in the adapter, into alignment.

Thereafter, the C-clamp member 26 is installed within the aligned opening as illustrated in FIG. 1—the rear upper and lower portions of the C-clamp being in bearing engagement with the bearing walls 24 and 25 of the adapter.

Thereafter the wedge member 28 is positioned with its arcuate rear surface 30 in contact relation with the projecting arcuate surface 29 of the C-clamp member. The nut 35 is positioned within the recess 38 (see FIG. 5) spaced below the projecting arcuate surface 29.

Thereafter, the threaded bolt 34 is inserted through the passages 32 and 31 of the wedge member 29 and C-clamp member 26, respectively and is threaded into the nut 35.

As the bolt 34 is tightened—the recess 38 being contoured to prevent the nut 35 from rotating, pressure is exerted against the arcuate surface 37 of the wedge member 28. This causes the arcuate confronting surface 30 to move downwardly along the forwardly projecting arcuate surface 29 and bring the arcuate surface 36 into engagement with the lip opening forward wall 13. The increased pressure developed by tightening the bolt 34 moves the wedge member 28 further forwardly while simultaneously urging the C-clamp member 26 rearwardly, thereby achieving a tight and secure but temporary fit.

The invention is especially advantageous in providing a lock readily accessible from the top and where the tightening action also occurs from the top—it being apparent that working form the under side of the excavator lip is not always particularly effective. This results in advantageous safety to the artisan because only tightening is performed rather than striking with a hammer as was required by the prior art.

The invention allows for greater dimensional variation in the lip and adapter. In the past, as the lip and adapter wore down the original edge needed to be removed and replaced with a larger size. The inventive system can be tightened to account for three oversize wedges.

Once frictional hold on the old style is broken the wedge was free to "walk" itself out, allowing the C-clamp to fall out and resulting in loss of the adapter. Even if the inventive system becomes loose in service the assembly will not come out and will not permit loss of the adapter.

While in the foregoing specification, a detailed description of an embodiment of the invention has been set down for the purpose of illustration, many variations in the details herein given may be made by those skilled in the art without departing from the spirit and scope of the invention.

We claim:

1. A locking device for securing a slip-over forwardly projecting adapter to an excavator lip comprising a C-clamp member straddling said lip while extending through vertically aligned openings in said adapter and lip, and a wedge member also extending through said aligned openings and forwardly of said clamp member, said clamp member having a forward facing wall confronting said wedge member and having a forwardly projecting arcuate surface, said wedge member having a rearwardly facing wall having an arcuate contour for sliding on said C-clamp member arcuate surface, a bolt means extending through said arcuate surfaces and releasably interconnecting said members whereby tightening of said bolt means causes said wedge member arcuate contour to slide on said C-clamp member arcuate surface to bear against said lip opening to lock said adapter on said lip.

2. The structure of claim 1 in which said bolt means extends through vertically aligned passages in said members.

3. The structure of claim 2 in which said C-clamp member passage is recessed for the receipt of a nut for said bolt means.

4. The structure of claim 2 in which said wedge member is equipped with an arcuate top wall for engagement with the head of said bolt means.

5. The structure of claim 1 in which said wedge member is equipped with an arcuate forwardly facing wall for engagement with the forward wall of said lip opening.

6. In combination, an excavating device providing a forwardly extending lip, an adapter on said lip and having legs straddling said lip, aligned openings extending through said adapter legs and lip, a locking device in said aligned openings and comprising a C-clamp member straddling said lip while extending through said vertically aligned openings and a wedge member also mounted in said lip opening and in bearing engagement with said C-clamp member to temporarily immobilize said adapter on said lip, said members having cooperating confronting arcuate surfaces, and bolt means extending through said confronting arcuate surfaces of said members and connecting said members for moving said wedge member arcuate surface on said C-clamp member arcuate surface to secure said adapter to said lip.

7. A locking device for securing a slip-on adapter to an excavator lip comprising a C-clamp member and a wedge member having confronting walls adapted to be arranged in bearing relation, at least a portion of each wall being arcuate about a predetermined center of curvature, aligned passages in said walls, and bolt means in said aligned passages coupling said members together, said aligned passages and said bolt means being located between said confronting walls and said center of curvature whereby shortening of said bolt means causing pivotal movement of said wedge member about said center of curvature while remaining in bearing relation with said C-clamp member.

8. The structure of claim 7 in which said wedge member passage is enlarged adjacent the confronting wall of said wedge member.

* * * * *